United States Patent [19]

Andrews

[11] Patent Number: 4,586,620

[45] Date of Patent: May 6, 1986

[54] RAILROAD CAR COUPLER ALIGNMENT DEVICE

[76] Inventor: Russell J. Andrews, 1114 Lange Rd., Birch Run, Mich. 48515

[21] Appl. No.: 602,803

[22] Filed: Apr. 23, 1984

[51] Int. Cl.[4] ..... B61G 3/14; B61G 7/00

[52] U.S. Cl. ..... 213/15; 213/1 R; 213/12; 213/19; 213/20; 280/477; 24/298; 24/302

[58] Field of Search ..... 213/1 R, 12, 15, 16, 213/19, 20, 162, 217; 280/477; 24/298, 299, 302

[56] References Cited

U.S. PATENT DOCUMENTS

| | | | |
|---|---|---|---|
| 259,719 | 6/1882 | Rasmussen | 213/12 |
| 950,472 | 3/1910 | Buhoup | 213/16 |
| 950,489 | 3/1910 | Matthews | 213/16 |
| 1,137,961 | 5/1915 | Forsyth | 213/20 X |
| 1,355,640 | 10/1920 | Butler | 24/299 X |
| 2,494,526 | 1/1950 | Tungett et al. | 24/298 |
| 4,179,353 | 11/1979 | Steele | 280/477 |
| 4,186,939 | 2/1980 | Woods et al. | 280/477 |

FOREIGN PATENT DOCUMENTS

| | | | |
|---|---|---|---|
| 2122962 | 6/1982 | United Kingdom | 280/477 |

*Primary Examiner*—Robert B. Reeves
*Assistant Examiner*—Scott H. Werny
*Attorney, Agent, or Firm*—Harry R. Dumont

[57] ABSTRACT

An alignment device for railroad car couplers including a central flexible portion with a pair of swivelable end portions connectable between couplers of adjacent cars. Each of the end portions includes a protruding stud adapted to engage an opening preformed in the knuckle body. The device end portions and their studs are inserted between misaligned adjacent couplers. One steady pull of the engine aligns the couplers so that two cars may then be quickly joined together without requiring the trainman to stand between the cars during the coupling operation.

5 Claims, 3 Drawing Figures

RAILROAD CAR COUPLER ALIGNMENT DEVICE

BACKGROUND OF THE INVENTION

This invention relates to an alignment device placed into position by a trainman between adjacent long shank couplers on two railroad cars.

The problem of linerally aligning railroad couplers prior to the coupling operation is well known in the art. As railroad cars became longer and heavier, the coupler shanks necessarily were increased in length and weight until at the present time they weigh of the order of five to six hundred pounds and to align them manually requires extreme effort by the trainman. The problem is compounded not only by the size of the coupler and draft gear but by the fact that these become rusted, bent and worn in operation so that they do not freely move into the necessary aligned position.

A still further problem exists in that in order to position such a heavy coupler manually, the trainman was required to stand between the railroad cars in order to apply the large forces needed. If the engineer unintentionally moved the train while the operator was attempting to position the couplers, he was in a very dangerous position. A large number of prior art coupler positioning devices have been developed which involve centering arrangements and centering spring and gear systems that are designed to maintain the couplers in a constant pre-aligned position. One example of this type of system as shown in H. C. Buhoup, U.S. Pat. No. 950,472 patented on Mar. 1, 1910 for "DRAFT GEAR".

An additional relatively complicated spring alignment system for this purpose is shown in G. H. Forsyth, U.S. Pat. No. 1,137,961 issued on May 4, 1950 for "DRAFT RIGGING MECHANISM". A still further spring pivoting system for this purpose is described and shown in U.S. Pat. No. 950,489 issued to W. R. Mathews on Mar. 1, 1910 for "DRAFT GEAR FOR RAILWAY CARS". An additional spring actuated type of centering system for drawbars is shown and described in J. F. O'Conner, U.S. Pat. No. 802,469 issued on Oct. 24, 1905 for "DRAW BAR CENTERING DEVICE FOR RAILWAY DRAFT RIGGING".

All the prior art approaches tended in the direction of expensive complicated mechanisms that were not readily adaptable to standard railway cars or to their relatively standardized coupler apparatus.

SUMMARY OF THE INVENTION

In order to overcome the difficulties encountered in prior art devices, the present invention will be seen to present a simple and straightforward solution to the problem. The device is easily handled by one man from either side of the track. Once it is in place, during the remainder of the coupling operation by the engineer, the trainman can stand free and spaced away from the dangerous position between cars. No modification or expensive change to the drawbar construction is required and indeed each of the standardized couplers has provided in it an opening that can be readily engaged by the stud extending from the alignment device for easy attachment and ready release after the alignment has been performed.

DESCRIPTION OF THE PREFERRED EMBODIMENT

Figure 1:
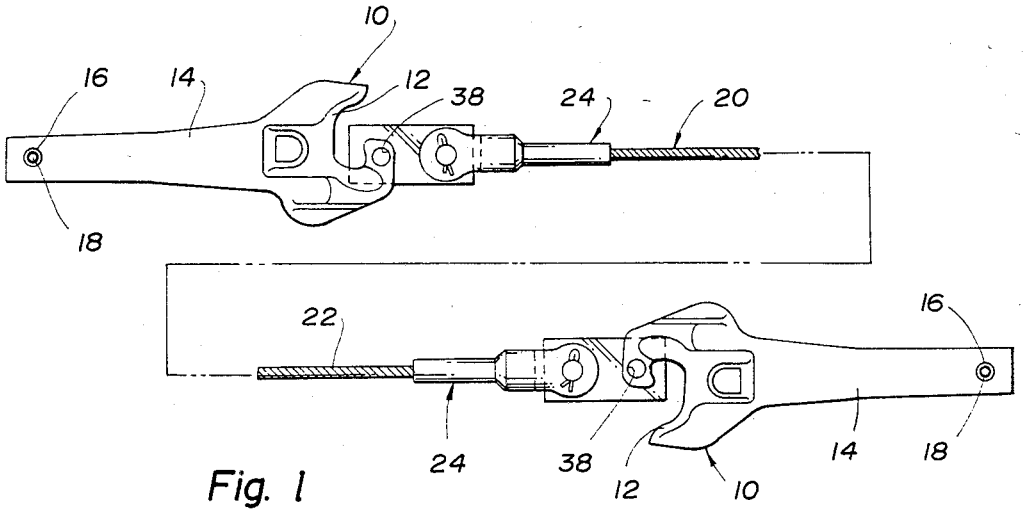
FIG. 1 is a top plan view of a pair of long shank Bailroad couplers with the alignment device in place for operation.

Referring now to the drawings in general with particular reference to FIG. 1, there is shown a pair of long shank type railroad couplers 10 which comprise a coupler head 12 formed on the end of the long shank 14 for receiving a coupler pin 18. The coupler 10 is carried on the underside of each end of the railroad car by means well known in the railroad car art and forming no part of the present invention.

The alignment device 20 is shown mounted in position preparatory to aligning adjacent couplers 10 before the cars are hooked together. Misalignment almost always occurs during connect or disconnect of the cars, after going around curves or simply through routine handling of the separate cars during load and unload.

Figure 2:
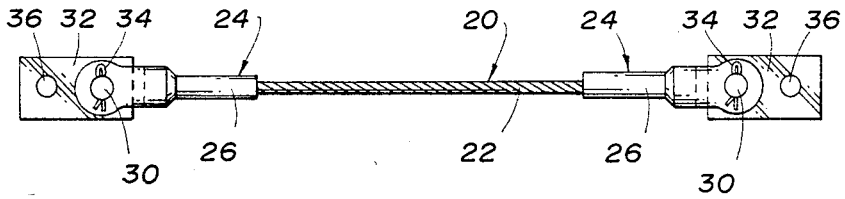
FIG. 2 is a top plan view of the alignment device.
Figure 3:
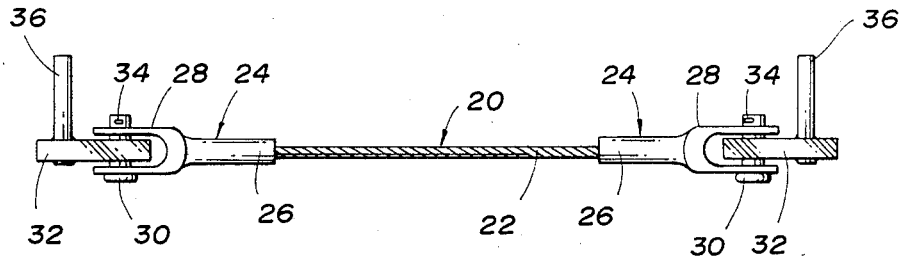
FIG. 3 is a elevational upside down view of the alignment device showing the detail of its construction.

The alignment device 20 is also shown in FIGS. 2 and 3. Included in the alignment device 20 is a central cable or flexible portion 22. Fixed to each end of the cable 22 are end portions 24. The end portions 24 are constructed to allow free swiveling movement of the end portions relative to the couplers as the cars are pulled first apart to align the adjacent couplers 10. The ends of the cable 22 are clamped, welded or otherwise fastened to the inner tubular ends 26 of the end portion 24 so that as the cars are separated their strong attachment is not disturbed. The end portions 24 end in a forked fitting 28 which engages and holds a stud 30 to which an end plate 32 is journaled. A cotter pin 34 or similar locking device is used to keep the end plates 32 engaged to forked fittings 28. The mating holes in the knuckles are shown in FIG. 1 by the numeral 38.

In the operation of the device, the trainman merely has to drop the studs 36 in place in the openings 38 and stand back while he signals the engineer to pull the railway cars apart. Once this is done the drawbars and the couplers 10 are in a linerally aligned position. The trainman can then lift the alignment device 20 out of its position and stand back while the engineer with a second movement of the railway car locks the two cars together.

It will thus be seen that I have provided by my invention a simple and portable alignment device for railroad car couplers. The use of this alignment device can be handled by a single operator and he is relieved from the danger of standing between adjacent railway cars as the couplers are aligned and the cars are coupled by the engineer.

I claim:

1. An alignment device for railroad couplers having openings normally provided in their upper surface, comprising;

a central flexible portion;

a pair of end portions connected to said central portion;

a plate connected to each of said end portions and having an outstanding first stud connected thereto for engagement with a respective one of said openings during a preliminary alignment operation of the couplers.

2. The combination as set forth in claim 1 in which said plates are connected to their respective end portions by a swivel connecting means.

3. The combination as set forth in claim 2 wherein each of said swivel connecting means comprises a plate having an opening, a forked fitting connected to said plate, and a second stud connected to said forked fitting and engagable with said opening formed in said respective plate.

4. The combination as set forth in claim 1 in which the central flexible portion comprises a steel cable.

5. The combination as set forth in claim 3 in which said second stud is maintained in place intermediate said fitting and said plate by a fastening device.

* * * * *